US006853372B2

(12) United States Patent
Kanzaki et al.

(10) Patent No.: US 6,853,372 B2
(45) Date of Patent: Feb. 8, 2005

(54) IMAGE DISPLAY DEVICE, IMAGE DISPLAY CONTROLLER, DISPLAY CONTROL METHOD, AND SIGNAL SUPPLYING METHOD

(75) Inventors: Eisuke Kanzaki, Fujisawa (JP); Manabu Kodate, Yokohama (JP)

(73) Assignee: International Business Machines Corporation, Armonk, NY (US)

( * ) Notice: Subject to any disclaimer, the term of this patent is extended or adjusted under 35 U.S.C. 154(b) by 260 days.

(21) Appl. No.: 10/178,198

(22) Filed: Jun. 21, 2002

(65) Prior Publication Data

US 2002/0196246 A1 Dec. 26, 2002

(30) Foreign Application Priority Data

Jun. 22, 2001 (JP) ..... 2001-190427

(51) Int. Cl.[7] ..... G09G 5/00
(52) U.S. Cl. ..... 345/208; 345/94
(58) Field of Search ..... 345/94, 95, 208, 345/210, 204, 52, 53

(56) References Cited

U.S. PATENT DOCUMENTS 4,924,214 A * 5/1990 Hill ..... 340/666
5,648,794 A * 7/1997 Jelsma et al. ..... 345/98
5,963,184 A * 10/1999 Tokunaga et al. ..... 345/60
6,295,042 B1 * 9/2001 Aoki ..... 345/94
2001/0045930 A1 * 11/2001 Miyajima et al. ..... 345/92

FOREIGN PATENT DOCUMENTS

JP 06-110035 * 4/1994 ..... G09G/3/36
JP 11-281957 * 10/1999 ..... G09G/3/20

* cited by examiner

*Primary Examiner*—Amare Mengistu
(74) *Attorney, Agent, or Firm*—Ira D. Blecker

(57) ABSTRACT

To easily reduce the occurrence of uneven luminance or flicker in a screen without any manufacturing or cost problems. An output potential waveform outputted from a switching unit 16 of a gate driver IC 7 to a scanning line G is set to have a first waveform having a potential for turning on a switching elements set as its amplitude, and a second waveform connected to the first waveform and oscillated within a period shorter than the second waveform with amplitude smaller than that of the first waveform. Thus, a falling waveform of a scanning signal to be supplied to the switching elements through the scanning line G is inclined beforehand, nonuniformity of the inclination of the falling waveform of the scanning signal supplied to each of the switching elements is reduced, and the occurrence of uneven luminance or flicker in the screen is suppressed.

15 Claims, 14 Drawing Sheets

IMAGE DISPLAY DEVICE, IMAGE DISPLAY CONTROLLER, DISPLAY CONTROL METHOD, AND SIGNAL SUPPLYING METHOD

BACKGROUND OF THE INVENTION

The present invention relates to an image display device for displaying an image based on an inputted display signal, and to an image display controller and a display control method for controlling the image display device.

As the image display device of such a type, for example, an active matrix liquid crystal display device using a switching element of a thin-film transistor (abbreviated to TFT, hereinafter) has been known. As shown in FIG. 8, a main portion of such a liquid crystal display device 50 includes, for example, a liquid crystal display panel 51 and a driving circuit unit.

The liquid crystal display panel 51 includes a liquid crystal material sealed between a TFT array substrate and a counter substrate disposed with a predetermined gap therefrom.

The TFT array substrate includes pluralities of signal lines S(1), S(2), xxx S(i), xxx S(N) and scanning signal lines G(1), G(2), xxx G(j), xxx G(M) disposed on a transparent insulating substrate 100 such as a glass substrate in a matrix form. At each intersecting portion of the signal lines and the scanning signal lines, a switching element 102, which is composed of a TFT and connected to a pixel electrode 103, is formed. An orientation film is provided so as to cover almost the entire surface of such components. Accordingly, the TFT array substrate is formed.

In addition, the counter substrate is formed by successively laminating a counter electrode 101 and an orientation film on the entire surface of a transparent insulating substrate such as a glass substrate as in the case of the TFT array substrate.

The driving circuit unit includes a scanning signal line driving circuit (gate driver) 300 connected to each of the scanning signal lines, a signal line driving circuit (source driver) 200 connected to each of the signal lines, and a counter electrode driving circuit COM connected to the counter electrode 101.

The scanning signal line driving circuit 300 includes, for example as shown in FIG. 9, a shift register unit 300*a* composed of cascade-connected flip-flops F1, F2, xxx amounting to M in number, and selecting switches 300*b* for switching in accordance with outputs from the respective flip-flops. A gate on voltage Vgh enough to turn on the switching element 102 (see FIG. 8) is applied to one input terminal VD1 of each of the selecting switches 300*b*. A gate off voltage Vgl enough to turn off the switching element 102 is applied to the other input terminal VD2. Accordingly, when a data signal (GSP) sequentially transferred through the flip-flops F1, F2, xxx by a clock signal (GCK) is successively outputted to the selecting switches 300*b*, each of the selecting switches 300*b* selects in response the voltage Vgh for turning on the switching element 102 for one scanning period (TH), outputs the voltage Vgh to each of scanning signal lines 105, and then outputs the voltage Vgl for turning off the switching element 102 to each of the scanning signal lines 105. This operation enables a video signal outputted from the signal line driving circuit 200 to each of signal lines 104 (see FIG. 8) to be written into each corresponding pixel.

FIG. 10 shows an equivalent circuit of one display pixel P(i, j) constructed in a manner that a pixel capacitance CIc and an auxiliary capacitance Cs are connected in parallel with each other to a counter potential of a counter electrode driving circuit COM. In the drawing, a reference code Cgd denotes a parasitic capacitance between a gate and a drain of the switching element 102.

Next, description will be made for a driving method of the liquid crystal display device 50. It is widely known that a liquid crystal needs AC driving to prevent a residual burned image and display deterioration, and a conventional driving method described below employs frame inversion driving, which is a kind of such AC driving.

FIG. 11 shows a driving waveform of the liquid crystal display device 50. In FIG. 11, a reference code Vg denotes a waveform of one scanning signal line; Vs denotes a waveform of one signal line; and Vd denotes a drain waveform.

As shown in FIG. 11, in a first field (TF 1), when a scanning voltage Vgh as shown in FIG. 11 is applied from the scanning signal line driving circuit 300 to the scanning line G(j) (see FIGS. 8 and 9), the switching element 102 connected to the scanning line G(j) is turned on. A video signal voltage Vsp from the signal line driving circuit 200 is written through source and drain electrodes of the switching element 102 into the pixel electrode 103. The pixel electrode 103 holds a pixel potential Vdp as shown in FIG. 11 until the scanning voltage Vgh is applied in a next field (TF 2). On the other hand, since the counter electrode 101 is set at a predetermined counter potential VCOM by the counter electrode driving circuit COM, the liquid crystal material sealed between the pixel electrode 103 and the counter electrode 101 responds to a potential difference between the pixel potential Vdp and the counter potential VCOM, thus allowing image displaying to be performed.

Similarly, in the second field (TF 2), when the scanning voltage Vgh shown in FIG. 11 is applied from the scanning signal line driving circuit 300 to the scanning line G(j), the switching element 102 is turned on, a video signal voltage Vsn from the signal line driving circuit 200 is written into the pixel electrode 103, and a pixel potential Vdn is held. The liquid crystal material responds to a potential difference between the pixel potential Vdn and the counter potential VCOM, thus allowing image displaying to be performed. As a result, liquid crystal AC driving is achieved.

Now, since the foregoing constitution inevitably leads to the formation of the parasitic capacitance Cgd between the gate and the drain of the switching element 102 as shown in FIG. 10, level shifting (delta Vd) occurs in the pixel potential Vd because of the parasitic capacitance Cgd at the falling of the scanning voltage Vgh as shown in FIG. 11. If a non-scanning time voltage (off-time voltage of the switching element 102) of a scanning signal is Vgl, then the following equation is established for the level shifting (delta Vd) occurring in the pixel potential Vd because of the parasitic capacitance Cgd inevitably formed in the switching element 102:

$$(\text{delta } Vd)=Cgd\times(Vgh-Vgl)/(C1c+Cs+Cgd)$$

Consequently, the level shifting causes problems including flicker and display deterioration on display images, which is not preferable for the liquid crystal display device directed to higher definition and quality.

Therefore, for example, it has been heretofore presented that the counter electrode 101 is biased to the counter potential VCOM by considering the level shifting (delta Vd) caused by the parasitic capacitance Cgd.

The scanning signal lines G(1), G(2), xxx G(j), xxx G(M) shown in FIGS. 8 and 9 are signal delay paths in which signal propagation delay occurs to a certain extent, because of the difficulty in formation thereof by ideal wires having no signal propagation delay.

FIG. 12 shows a propagation equivalent circuit when attention is paid to the signal propagation delay of one scanning signal line G(j). Reference numerals rg1, rg2, rg3, xxx rgN in FIG. 12 denote resistance components of a wire material forming the scanning signal line G(j), and resistance components based on wire widths and lengths. In addition, reference numerals cg1, cg2, cg3, xxx cgN denote various parasitic capacitances having capacitance coupling relations with the scanning signal line G(j) in terms of the constitution thereof. For example, the parasitic capacitances are composed of cross capacitances generated by crossing with the signal lines. Thus, the scanning signal line G(j) is a signal propagation delay path of a distribution constant type.

FIG. 13 shows a state where a scanning signal VG(j) inputted from the foregoing scanning signal line driving circuit 300 to the scanning signal line G(j) is deformed inside a panel because of the above-described signal propagation delay characteristic of the scanning signal line G(j). In FIG. 13, a waveform Vg(1, j) indicates a waveform of a scanning signal in a portion g(1, j) (see FIG. 12) in the vicinity of an input end on the scanning signal line G(j), exhibiting almost no waveform deformation. On the other hand, a waveform Vg(N, j) in the drawing indicates a waveform of a scanning signal in a portion g(N, j) (see FIG. 12) in the vicinity of a termination on the scanning signal line G(j). Compared with the waveform Vg(1, j), the waveform Vg(N, j) is more deformed because of the signal propagation delay characteristic of the scanning signal line G(j). This waveform deformation generates a changing amount SyN per unit time.

In addition, the switching element 102 composed of the TFT is not a complete on and off switch, and has a V-I characteristic (gate voltage-drain current characteristic) as shown in FIG. 14. In FIG. 14, an abscissa indicates a voltage Vg applied to the gate of the switching element 102; and an ordinate indicates a drain current Id. Normally, a scanning signal is composed of a rectangular pulse including a voltage level Vgh enough to turn on the switching element 102 and a voltage level Vgl enough to turn off the same. However, as shown in the drawing, an intermediate on area (linear area) is present from a threshold value VT of the switching element 102 to the Vgh level.

As shown in FIG. 13, the falling of the scanning signal from Vgh to Vgl instantaneously occurs in the pixel positioned in the vicinity of g(1,j)(see FIG. 12). Thus, there is no influence from the characteristic of the foregoing TFT linear area, and the level shifting (delta Vd(1)) occurring in the pixel potential Vd(1, j) because of the above-described parasitic capacitance Cgd can be approximated to the following:

$$(\text{delta } Vd)=Cgd\times(Vgh-Vgl)/(C1c+Cs+Cgd)$$

However, in the pixel positioned in the vicinity of g(N, j) (see FIG. 12) as the termination of the scanning signal line G(j), the scanning signal is deformed at the falling. Accordingly, there is influence from the characteristic of the TFT linear area, and no level shifting occurs in the pixel potential Vd caused by the parasitic capacitance Cgd. This is because the switching element 102 is on in the linear area while the scanning signal falls from Vgh to the vicinity of the threshold value level VT of the TFT. In an area where the scanning signal further changes from the vicinity of the threshold value level VT to Vgl, level shifting (delta Vd(N)) occurs in the pixel potential Vd(N, j) because of the above-described parasitic capacitance Cgd. Thus, the level shifting (delta Vd(N)) becomes as follows:

$$(\text{delta } Vd(N))<Cgd\times(Vgh-Vgl)/(C1c+Cs+Cgd)$$

Then, the following is established:

$$(\text{delta } Vd(1))>(\text{delta } Vd(N))$$

Therefore, the level shifting (delta Vd) occurring in the pixel potential Vd because of the parasitic capacitance Cgd in the panel becomes nonuniform in the display surface, which cannot be ignored along with achievement of a larger screen and higher definition. In other words, a counter voltage biasing method of the conventional system cannot absorb the nonuniformity of the level shifting in the display surface, and any pixels cannot be AC-driven optimally. Consequently, inconvenience inevitably occurs, such as the occurrence of flicker, a residual burned image by a DC component application and the like.

Thus, in the conventional case, methods described below have been presented in order to prevent the nonuniformity of the level shifting (delta Vd) in the display surface.

For example, a gazette of Japanese Patent Laid-Open Hei 11 (1999)-281957 discloses a technology for controlling a falling inclination of a scanning signal by adding a throughrate control element to an output stage of a gate driver. The throughrate control element enables a falling waveform of the output of the scanning signal to be optionally set based on a changing amount thereof per unit time.

A gazette of Japanese Patent Laid-Open Hei 6 (1994)-110035 discloses a technology for reducing nonuniformity of the level shifting (delta Vd) in the display surface by setting a falling waveform of a scanning signal to be a ramp waveform, an exponential waveform or a stair waveform so as to reduce high frequency components of the scanning signal, and thereby suppressing the level shifting (delta Vd) itself.

However, in such conventional technologies, a certain kind of circuit must be added inside the gate driver or between the gate driver and the scanning line, making it difficult to use general-purpose components, or complicating a circuitry. Consequently, manufacturing and cost problems are inevitable.

BRIEF SUMMARY OF THE INVENTION

The present invention was made with the foregoing problems in mind, and an object of the present invention is to provide an image display device, an image display controller, a display control method, and a signal supplying method.

In order to achieve the foregoing object, the image display device of the invention comprises: a plurality of pixel electrodes; a display signal supply unit for supplying a display signal to each of the pixel electrodes; a display signal control element for controlling the supplying of the display signal to each of the pixel electrodes; and a potential output unit for outputting a potential to the display signal control element. In this case, the potential output unit sets an output waveform to have a first waveform having amplitude defined by a potential for turning on the display signal control element, and a second waveform following the first waveform. The second waveform is oscillated within a period shorter than that of the first waveform with amplitude smaller than that of the first waveform.

Thus, when the potential output unit outputs a potential composed of the first and second waveforms to the display signal control element, and then turns off the potential, because of a load applied by the display signal control element or the like, a potential actually applied to the display signal control element follows a change in the output potential of the potential output unit in a delayed manner, and is changed into a waveform, where a portion of the second waveform gradually falls while being oscillated. In other words, a potential supplied to the display signal control element, i.e., a scanning signal, can be set in a state where the falling portion thereof is inclined beforehand. Moreover, when such a scanning signal is supplied through a single scanning line to a plurality of display signal control elements, the falling portion of the scanning signal is inclined beforehand. Accordingly, falling waveforms of the inputted scanning signal are compared between the display signal control element connected to the vicinity of an input end of the scanning line, to which the scanning signal is inputted, and the display signal control element connected to the vicinity of a termination of the display signal control element, nonuniformity of inclinations thereof is suppressed. Thus, it is possible to solve the problems of uneven luminance and flicker of an image in a direction along the scanning line.

In this case, the potential output unit includes: an original scanning signal output unit for outputting an original scanning signal composed of a pulse waveform; an output control unit for controlling permission of an output of the original scanning signal to the display signal control element; and a control signal supply unit for supplying a control signal to control the output control unit. Thus, the control signal supply unit can be provided outside the output control unit, i.e., a gate driver IC. As a result, a general-purpose component can be used for the gate driver IC.

Furthermore, in this case, the control signal supply unit supplies a control signal to the output control unit, the control signal being composed of a pulse for turning on the output control unit, and a pulse train provided following the pulse and oscillated within a period shorter than a cycle of the pulse. Thus, the output control unit can be operated so as to be turned on for a predetermined period by the pulse, and then repeatedly turned on and off at a short cycle by the pulse train. As a result, the first and second waveforms can be easily outputted.

Also, in this case, the output control unit is provided in the input end of the scanning line for applying a potential for turning on the display signal control element. Thus, it is not necessary to provide any special circuits or the like between the gate driver IC and the scanning line.

Furthermore, in this case, the control signal supply unit includes: a pulse generation unit for generating the pulse; a pulse train generation unit for generating the pulse train; and a superposition unit for superposing waveforms generated by the pulse generation unit and the pulse train generation unit. Thus, it is possible to generate a control signal only by a pulse generation mechanism and a signal superposition mechanism.

The pulse train generation unit includes: an additional pulse generation unit for continuously generating additional pulses constituting the pulse train; a mask signal generation unit for generating a mask signal for partially masking the additional pulses at a predetermined cycle; and a pulse train output unit for outputting a logical product of the additional pulses and the mask signal, as the pulse train. Thus, it is possible to easily generate the pulse train.

In this case, the mask signal generation unit changes a timing of the mask signal for partially masking the additional pulses based on one or more characteristics of a scanning line connecting the output control unit with the display signal control element, a parasitic capacitance accompanying the scanning line, and a gate driver IC connected to the scanning line. Thus, it is possible to optimize the timing of adding a pulse train by allowing the timing to correspond to characteristics of the device.

The image display device of the present invention comprises: a pixel electrode; a signal line for supplying a display signal to the pixel electrode; a display signal control element for controlling permission of the supplying of the display signal from the signal line to the pixel electrode based on a scanning signal; and a scanning line for supplying the scanning signal to the display signal control element. In this case, the scanning signal inputted from the scanning line to the display signal control element is a pulse signal including a waveform having a rising portion, a horizontal portion following the rising portion, and a falling portion following the horizontal portion and having an inclination oscillated positively and negatively at a cycle shorter than a period of the horizontal portion.

Thus, since the scanning signal inputted to the display signal control element has such a characteristic in the falling portion thereof, it is possible to minimize a difference in timings of the display signal control element from the on state to the off state, the difference being caused by nonuniformity in the inclination of the falling portion of the scanning signal.

Here, the image display device further comprises: a scanning signal output unit for outputting the scanning signal as a pulse; and a switching unit provided between the scanning signal output unit and the input end of the scanning line. In this case, the switching unit is operated to be turned on for a predetermined period, and then repeatedly turned on and off within a period shorter than the predetermined period. Thus, when the scanning signal is made to be supplied to the display signal control element through the scanning line, the scanning signal supplied to the display signal control element can be easily set to have the foregoing falling portion.

The present invention provides an image display controller for outputting a scanning signal for controlling permission of a supply of a display signal to a pixel electrode, comprising: a scanning signal generation unit for generating the scanning signal; a switching unit for controlling an output of the scanning signal from the scanning signal generation unit; and a control signal generation unit for generating a control signal for controlling an operation of the switching unit. In this case, the control signal generation unit includes: an original signal output unit for outputting an original signal composed of a rectangular pulse; an additional signal output unit for outputting an additional signal for repeatedly turning on and off for a predetermined period including a falling timing of the original signal; and a control signal output unit for outputting a signal having the additional signal added to the original signal, as the control signal. Thus, it is possible to control the scanning signal outputted through the switching unit to have a desired waveform.

In this case, the additional signal to be added to the original signal may be, for example, a triangular pulse or a sine wave. However, by use of the rectangular pulse wave, the additional signal can be generated most easily.

In this case, a duty ratio of the rectangular pulse wave is determined based on a characteristic of a device to which the scanning signal is outputted. Thus, it is possible to set the inclination of the falling of the scanning signal to be optimal for eliminating uneven luminance or the like on a screen.

The present invention provides a display control method for controlling a display image by supplying a display signal to a pixel electrode through a display signal control element controlled to be turned on and off by a scanning signal, comprising: a step (A) of adding a oscillation wave to a predetermined area including a falling portion of an original scanning signal set as an on and off binary signal; a step (B) of inclining a falling waveform of a scanning signal in comparison with the falling portion of the original scanning signal by outputting one obtained by adding the oscillation wave to the original scanning signal, as a scanning signal, to a scanning line accompanied with a parasitic capacitance; and a step (C) of supplying the scanning signal of the inclined falling waveform from the scanning line to the display signal control element.

Here, in the step (A), to add the oscillation wave, the turning on and off of the output of the original scanning signal is controlled in such a way as to be turned on for a predetermined period, and then repeatedly turned on and off within a period shorter than the predetermined period. Thus, it is possible to easily add the oscillation wave.

In addition, the oscillation wave added in the step (A) should preferably be changed in a binary manner with amplitude identical to that of the turning on and off of the original scanning signal. Thus, it is possible to easily oscillate the falling portion of the scanning signal.

Moreover, in this case, a characteristic of the oscillation wave is determined based on one or more characteristics of the scanning line, the parasitic capacitance accompanying the scanning line, and a gate driver IC connected to the scanning line. Thus, it is possible to maximize an effect of suppressing uneven luminance or the like. In this case, as the characteristic of the oscillation wave, for example, a frequency, level, period for addition, and so on are conceivable.

Especially, regarding the characteristic of the oscillation wave, a cycle of the oscillation wave should preferably be set to be shorter compared with a falling time of the scanning signal, which is supplied to the display signal control element connected to a termination of the scanning line when assuming that the original scanning signal is directly inputted to an input end of the scanning line. Thus, it is possible to maximize an effect of oscillating the falling portion of the scanning signal in the vicinity of the termination of the scanning line.

The present invention also provides a signal supplying method for supplying a scanning signal to each of a plurality of display signal control elements, the scanning signal to control turning on and off of each of the display signal control elements, through a scanning line accompanied with a parasitic capacitance and connected to the plurality of display signal control elements between the input end and the termination. The signal supplying method comprises: a step (A) of successively inputting a first signal and a second signal to a switching unit provided in the input end, the first signal being for turning on the switching unit and the second signal being repeatedly turned on and off at a cycle shorter than that of the on state; a step (B) of setting a scanning signal, composed of a rectangular pulse, to be a waveform by inputting the scanning signal to the input end of the scanning line through the switching unit, the waveform of the falling portion from the on state to the off state having an inclination changed positively and negatively after the on state thereof for a predetermined period; and a step (C) of inputting the scanning signal having the waveform changed in the step (B) from the scanning line to each of the display signal control elements. Thus, by controlling the output of the scanning signal by the switching unit, it is possible to uniform the inclination of the scanning signal supplied to the display signal control element by use of the characteristic of the scanning line as a signal propagation delay path. It is not necessary to incline the scanning signal beforehand.

BRIEF DESCRIPTION OF THE DRAWINGS

For a more complete understanding of the present invention and the advantages thereof, reference is now made to the following description taken in conjunction with the accompanying drawing.

FIG. 4A showing a case where no loads are applied on the scanning line; FIG. 4B, a case where a load is applied on the scanning line.

DETAILED DESCRIPTION OF THE PREFERRED EMBODIMENTS

Next, detailed description will be made for a preferred embodiment of the present invention with reference to the accompanying drawings.

Figure 1:
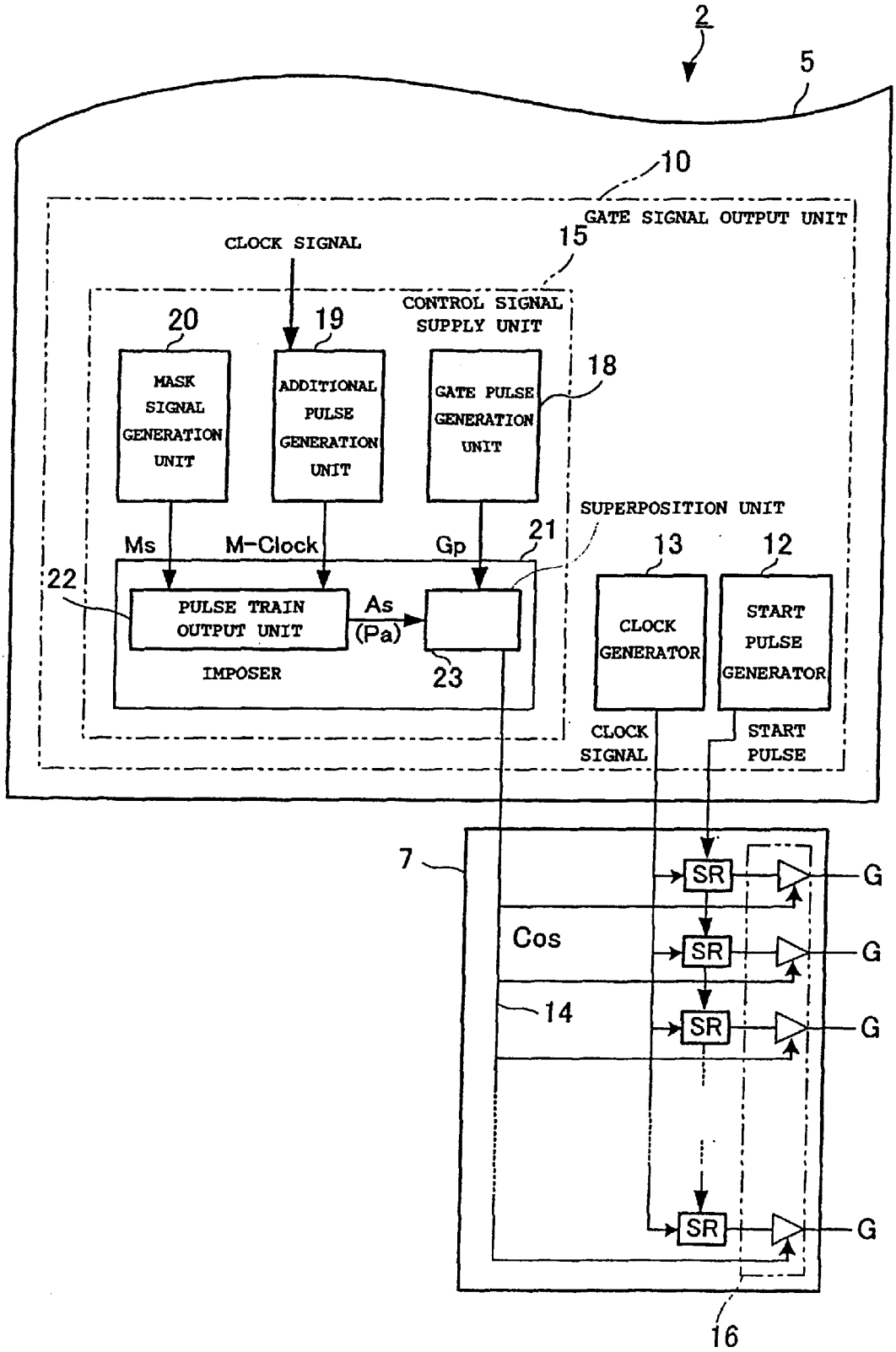
FIG. 1 is a schematic constitutional view showing main portions of an image display device according to an embodiment of the present invention.
Figure 2:
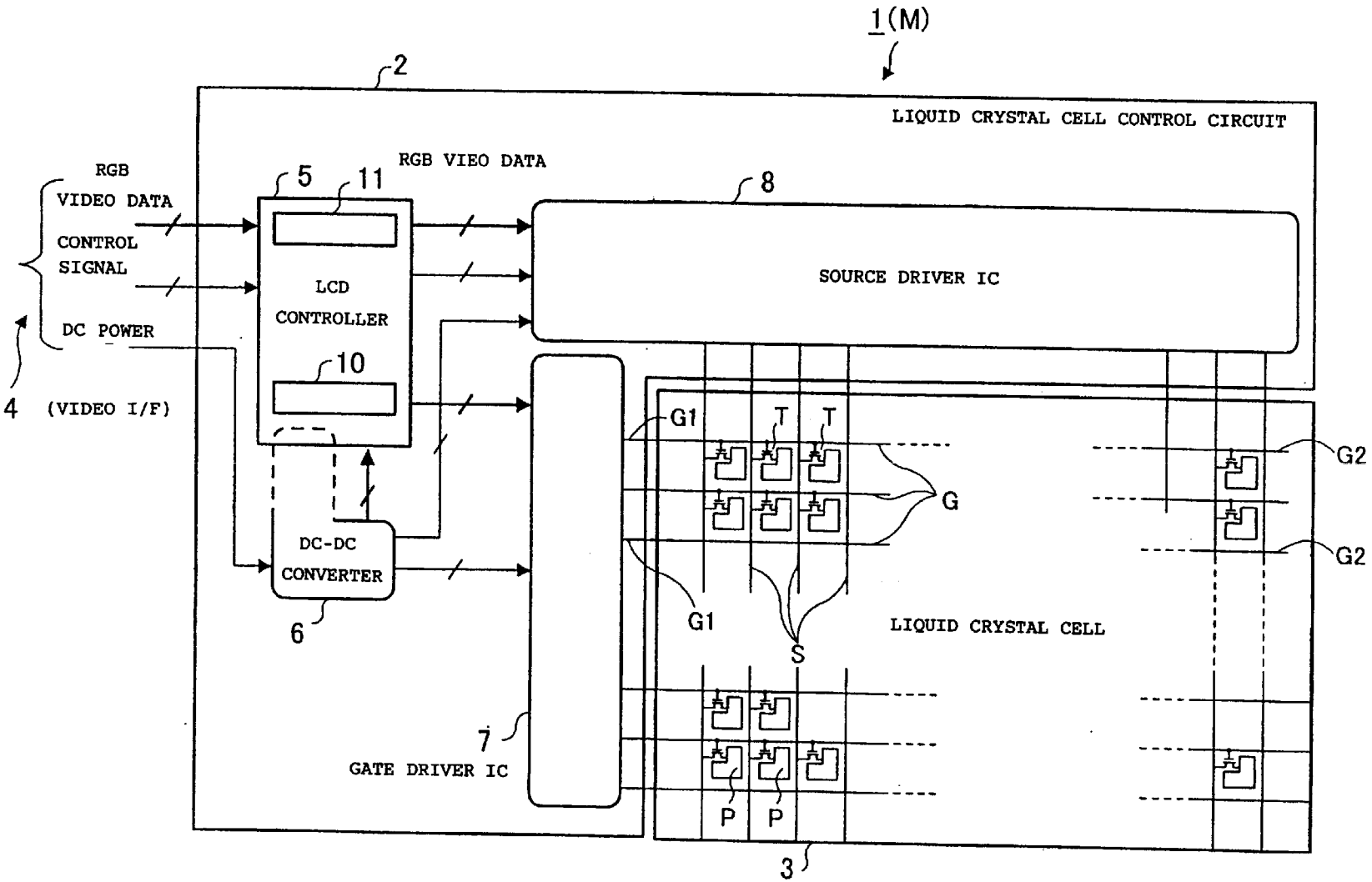
FIG. 2 is an entire constitutional view of the image display device shown in FIG. 1.

FIG. 1 is a constitutional view of main portions of an image display device according to an embodiment of the present invention; and FIG. 2 is a schematic constitutional view of the entire image display device shown in FIG. 1. As shown in FIG. 2, the image display device 1 of the present invention is formed as a liquid crystal module (LCD panel) M comprising a liquid crystal cell control circuit (image display controller) 2, and an active matrix liquid crystal cell 3 having a TFT set as a switching element.

This liquid crystal module M is formed in a display device separated from a system device of a host side, e.g., a personal computer (PC) or the like, alternatively in its display unit in the case of a notebook PC. The liquid crystal module M is constituted such that RGB video data or a control signal is inputted from a graphics controller LSI (not shown) of the system side through a video interface (I/F) 4 to an LCD controller 5 of the liquid crystal cell control circuit 2. In addition, DC power is also supplied through the video I/F 4.

A DC-DC converter 6 generates various DC source voltages needed in the liquid crystal cell control circuit 2 from the supplied DC power, and supplies the DC source voltages to a gate driver IC (potential output unit) 7, a source driver IC (display signal supply unit) 8, and a backlight fluorescent tube (not shown), and others.

The LCD controller 5 includes a gate signal output unit (potential output unit) 10 and a source signal output unit 1 1 which are for processing signals received from the video I/F 4 and for supplying the processed signals to the gate driver IC 7 and the source driver IC 8, respectively. The source driver IC 8 outputs a display signal to each of signal lines S arrayed in a horizontal direction (X direction) based on a signal inputted from the LCD controller 5 in an array of TFTs arranged in a matrix form on the liquid crystal cell 3. The display signal outputted to each of the signal lines S is supplied through a switching element (display signal control element) T to a pixel electrode P.

On the other hand, the gate driver IC 7 outputs a scanning signal to each of scanning lines G arrayed in a perpendicular direction (Y direction) based on a signal inputted from the LCD controller 5. This scanning signal is supplied to the switching element T, and turning on and off of the switching element T is controlled based on the supplied scanning signal.

FIG. 1 shows the gate driver IC 7 and the gate signal output unit 10 in the liquid crystal cell control circuit 2. As shown in the drawing, the gate signal output unit 10 includes: a start pulse generator (original scanning signal output unit, scanning signal output unit, and scanning signal generation unit) 12 for generating a start pulse (original scanning signal) to be an original signal of a scanning signal to be inputted from the gate driver IC 7 to the scanning line G; a clock generator (scanning signal generation unit) 13 for outputting a clock signal for driving the gate driver IC 7; and a control signal supply unit (control signal generation unit) 15 for outputting a control signal through an output enable (EO) line 14 to the gate driver IC 7.

The gate driver IC 7 includes shift registers (scanning signal generation units) SR provided corresponding to each of the scanning lines G and a switching unit (output control unit) 16. Each of the shift registers SR outputs a start pulse outputted from the start pulse generator 12, as a scanning signal, to each of the scanning lines G in synchronization with a clock signal outputted from the clock generator 13. In addition, the switching unit 16 is positioned in the input end of the scanning line G, and controls permission of an output of a scanning signal from the shift register SR to the scanning line G based on a control signal inputted through the EO line 14.

On the other hand, the control signal supply unit 15 includes a gate pulse generation unit (original signal output unit) 18, an additional pulse generation unit (additional signal output unit) 19, a mask signal generation unit 20, and an imposer 21. The gate pulse generation unit 18 continuously generates a gate pulse Gp (see FIG. 3) to be an original signal of the scanning signal. The additional pulse generation unit 19 generates additional pulses M_Clock (see FIG. 3) for forming an additional signal As (see FIG. 3) to be added to the gate pulse Gp that is the original signal. By referring to a clock signal inputted from a not-shown clock generation mechanism, a frequency, a level, or a duty ratio (ratio between on and off times of a pulse) of each of the additional pulses M_Clock can be adjusted.

The mask signal generation unit 20 generates a mask signal Ms (see FIG. 3) for partially masking the additional pulse M_Clock generated by the additional pulse generation unit 19. Moreover, the mask signal generation unit 20 is constituted such that a timing for masking the additional pulse M_Clock with the mask signal Ms can be adjusted. Note that the additional pulse generation unit 19 and the mask signal generation unit 20 can respectively change the frequency and the duty ratio of the additional pulse M_Clock, or the timing of a value "0" of the mask signal Ms (or timing of "1") based on one or more characteristics of the respective portions of the device, for example, the characteristics of the scanning line G for connecting the switching unit 16 with the switching element T, the parasitic capacitance accompanying the scanning line G, and the gate driver IC 7 connected to the scanning line G.

The imposer 21 includes a pulse train output unit 22 and a superposition unit 23. As described later, the pulse train output unit 22 generates a pulse train Pa by logically multiplying the additional pulse M_Clock by the mask signal Ms to partially mask the additional pulse M_Clock, and then outputs the pulse train Pa as an additional signal As. The superposition unit 23 superposes the additional signal As outputted from the pulse train output unit 22 on the gate pulse Gp, and then outputs the obtained signal. The output from the superposition unit 23 is inputted as an output from the control signal supply unit 15 to the gate driver IC 7.

Next, description will be made for the operations of the image display device 1 and the liquid crystal cell control circuit 2.

Figure 3:
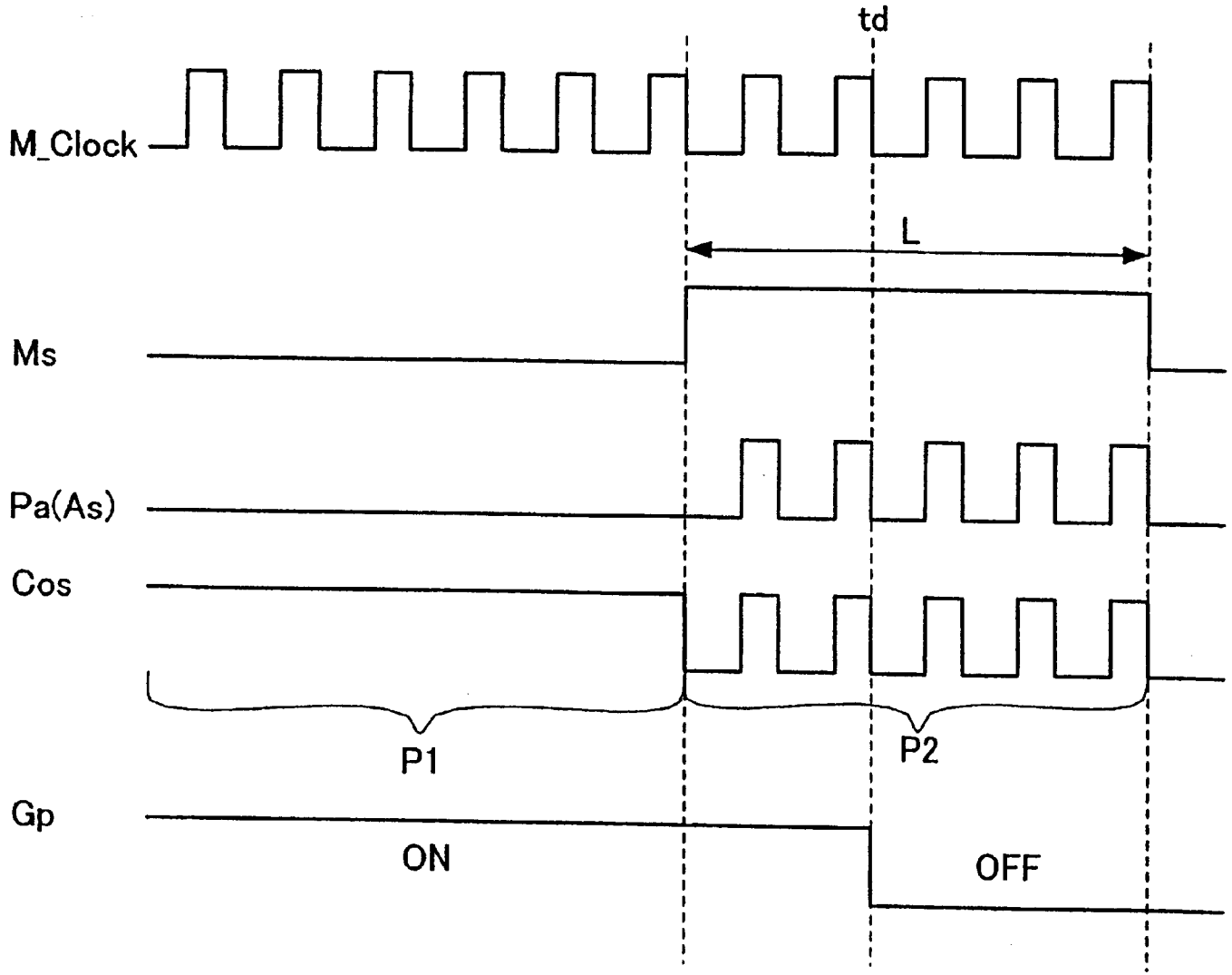
FIG. 3 is a waveform diagram of each signal generated by a control signal supply unit shown in FIG. 2.

FIG. 3 shows in parallel the waveforms of the signals generated at the control signal supply unit 15. A gate pulse Gp shown in FIG. 3 is generated as a rectangular pulse, but only a falling timing of this rectangular pulse and a timing in the vicinity thereof are shown here.

As shown in FIG. 3, potentials of a high level and a low level of the M_clock are set identical to potentials of the on state and the off state of the gate pulse Gp, respectively, and a cycle of the M_clock is sufficiently shorter than that of the gate pulse Gp. Specifically, the cycle of the additional pulse M_Clock is set to, for example, about 50 ns, while the cycle of the gate pulse Gp is set equal to a scanning period (e.g., about 10 microseconds) of one scanning line G in the liquid crystal panel.

In addition, as shown in FIG. 3, the mask signal Ms generated at the mask signal generation unit 20 is a data signal to take two values, i.e., "1" only in a certain period L, and "0" in other periods. Here, the period L when the value of the mask signal Ms is "1" is a predetermined period including a falling time td of the gate pulse Gp. Note that the period L may also be a predetermined period after the time td.

At the control signal supply unit 15, the additional pulse M_Clock generated by the additional pulse generation unit 19 is outputted to the pulse train output unit 22 of the imposer 21, and is logically multiplied by the mask signal Ms outputted from the mask signal generation unit 20. Thus, at the pulse train output unit 22, a pulse train Pa as shown in FIG. 3 is generated. This pulse train Pa is outputted as the additional signal As to the superposition unit 23, and is added to the gate pulse Gp generated at the gate pulse generation unit 18. Accordingly, a control signal Cos as shown in FIG. 3 is obtained. The control signal Cos thus obtained is composed of a pulse (first signal) P1 for turning on the switching unit 16 and a subsequent pulse train (second signal) P2 having amplitude identical to that of the pulse P1 and repeatedly turning on and off within a period shorter than the cycle of the pulse P1.

Figure 4A:
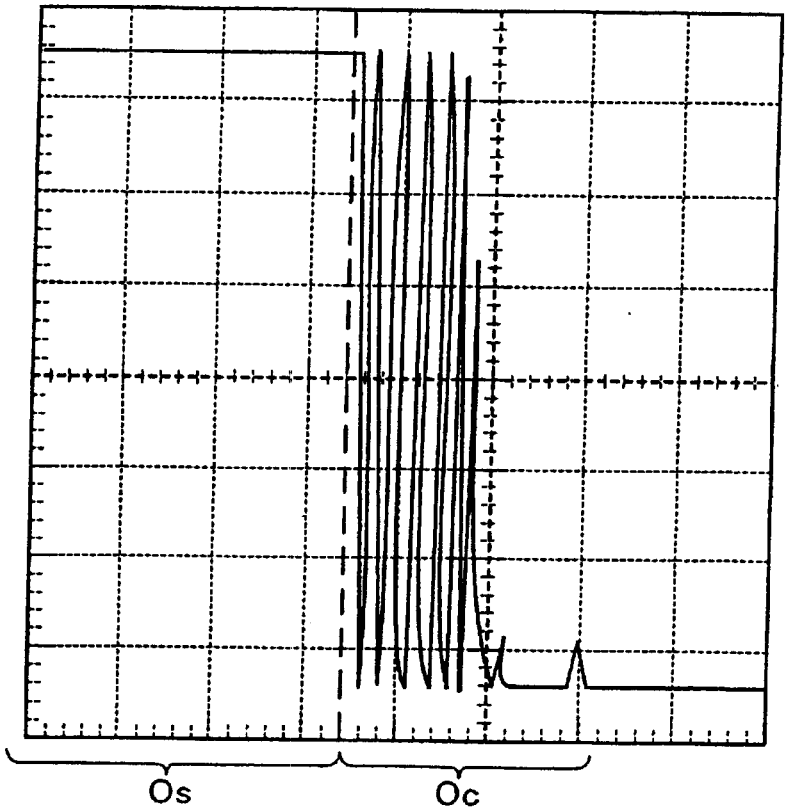
FIGS. 4A and 4B are waveform diagrams of scanning signals outputted to a scanning line shown in FIG. 1.

On the other hand, in the gate driver IC 7, a start pulse outputted from the start pulse generator 12 is successively transferred to the shift registers SR. Accordingly, each of the shift registers SR is shifted to an on state in synchronization with a clock signal outputted from the clock generator 13. Simultaneously, the control signal Cos as described above is outputted to the switching unit 16. Accordingly, corresponding to the pulse P1 and pulse train P2 of the control signal Cos, the switching unit 16 is operated so as to be turned on for a predetermined period and then repeatedly turned on and off for a period shorter than the above predetermined period. In such a case, assuming that no loads accompany the scanning line G, it is expected that a scanning signal (potential) inputted to the scanning line G will take such a waveform, as shown in FIG. 4A, that follows an original scanning signal Os composed of a rectangular pulse and is added with an oscillation wave Oc.

Figure 4B:
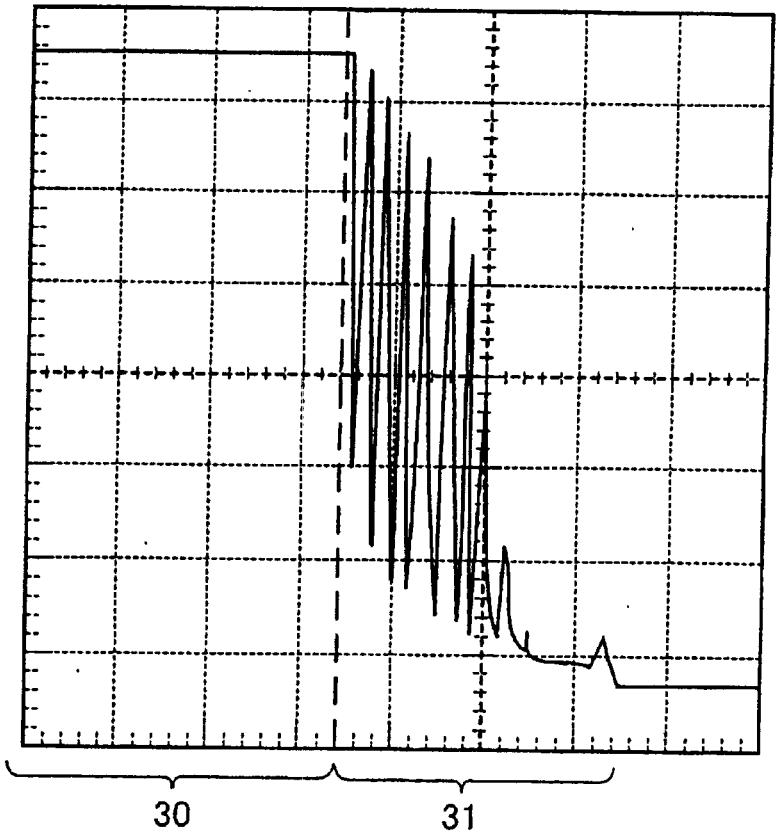

In actuality, however, the scanning line G is a signal propagation delay path of a distribution constant type, because the scanning line G itself has a resistance value, and the scanning line G has a capacitance coupling relation with the parasitic capacitance between the gate and the drain of the switching element T in each pixel. Thus, the waveform of the scanning signal outputted to the scanning line G has, as shown in FIG. 4B, a horizontal portion 30 following a rising portion (not shown), and a falling portion 31 following the horizontal portion 30. The falling portion has an inclination oscillated positively and negatively at a cycle shorter than the period of the horizontal portion 30. In other words, in the scanning signal Gs, the falling waveform supplied to the switching element T connected to any of the positions of the scanning line G has an inclination.

Figure 5:
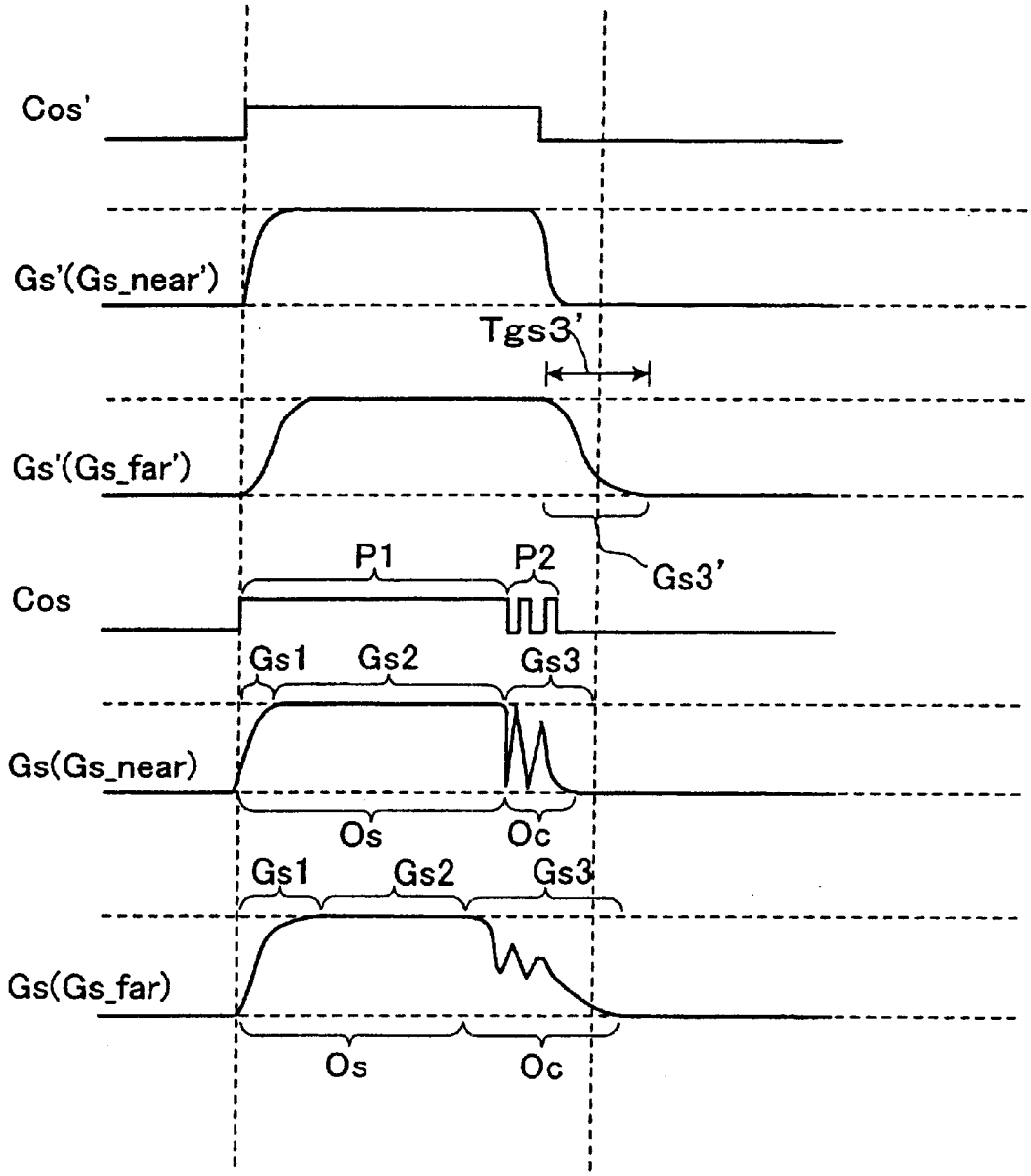
FIG. 5 is a schematic view showing a change in a waveform of a scanning signal supplied to a switching element, the change being caused by a difference between control signals supplied to a switching unit shown in FIG. 2: an uppermost stage showing a waveform of a conventional control signal; second and third stages showing waveforms of scanning signals respectively supplied to switching elements connected to an input end and a termination of the scanning line when the control signal of the uppermost stage is supplied to the switching unit; a fourth stage showing a waveform of a control signal of the present invention; and fifth and lowermost stages showing waveforms of scanning signals respectively supplied to the switching elements connected to the input end and the termination of the scanning line when the control signal of the fourth stage is supplied to the switching unit.

That is, as in the conventional case, when a control signal Cos' having no additions of a pulse train P2 or the like, as shown in FIG. 5, is supplied to the switching unit 16, a scanning signal Gs' reaching the switching elements T has its rising portion and falling portion gradually deformed along the scanning line G. In other words, as shown in FIG. 5, when a scanning signal Gs_near' inputted to the switching element T positioned near the input end G1 (see FIG. 2) of the scanning line G is compared with a scanning signal Gs_far' inputted to the switching element T positioned far from the input end G1 of the scanning line G, the falling portion of the scanning signal Gs_far' has a gentler inclination, and nonuniformity occurs in the inclination of the falling portion of the scanning signal Gs' along the scanning line G. Such nonuniformity of the inclination of the falling portion of the scanning signal Gs' leads to nonuniformity of an on and off timing of the switching elements T, which in turn causes the timing nonuniformity of the level shifting of the pixel potential. Consequently, flicker and uneven luminance in the left and right sides of the screen occur.

However, when the control signal Cos as shown in FIG. 5 is supplied to the switching unit 16, the potential of the signal propagation delay path composed of the scanning line G and the accompanying parasitic capacitance cannot follow the turning on and off of the switching unit 16 operated by the pulse train P2 after the pulse P1. Thus, the scanning signal Gs supplied to the switching element T connected to the scanning line G has a waveform having a oscillation wave (second waveform) Oc added to an original scanning signal (first waveform) Os, as shown in FIG. 5. In other words, in the case of the scanning signal Gs, each waveform of Gs_near inputted to the switching element T near the input end G1 of the scanning line G, and Gs_far inputted to the switching element T far from the input end G1 (see FIG. 1) has a rising portion Gs1, a horizontal portion Gs2 following the rising portion Gs1, and a falling portion Gs3 following the horizontal portion Gs2. The falling portion Gs3 has an inclination oscillated positively and negatively at a cycle shorter than the period of the horizontal portion Gs2.

Therefore, the scanning signal Gs inputted to the switching element T has the inclined falling portion Gs3 at any position along the scanning line G. Accordingly, compared with the conventional case, the nonuniformity of the inclination of the falling portion Gs3 of the scanning signal Gs along the scanning line G is reduced more. The timing nonuniformity of the turning on and off of the switching element T is thus reduced, making it possible to reduce the timing nonuniformity of the level shifting of the pixel potential caused by the parasitic capacitance. As a result, the problems of uneven luminance in the left and right sides of the screen and flicker can be solved.

As apparent from FIGS. 4A and 4B and FIG. 5, by supplying the pulse train P2 to the switching unit 16, a cycle of on and off repetition of the switching unit 16, that is, a cycle of the pulse train P2 and the additional pulse M_Clock which is the original signal of the pulse train P2 is made shorter than a period Tgs3'. The period Tgs3' is a period of the falling portion Gs3' of the scanning signal Gs_far' supplied to the switching element T connected to the termination G2 (see FIG. 1) opposite to the input end G1 of the scanning line G when the control signal Cos' (see FIG. 5) having no additions of a pulse train Pa or the like is supplied to the switch unit 16.

Figure 6:
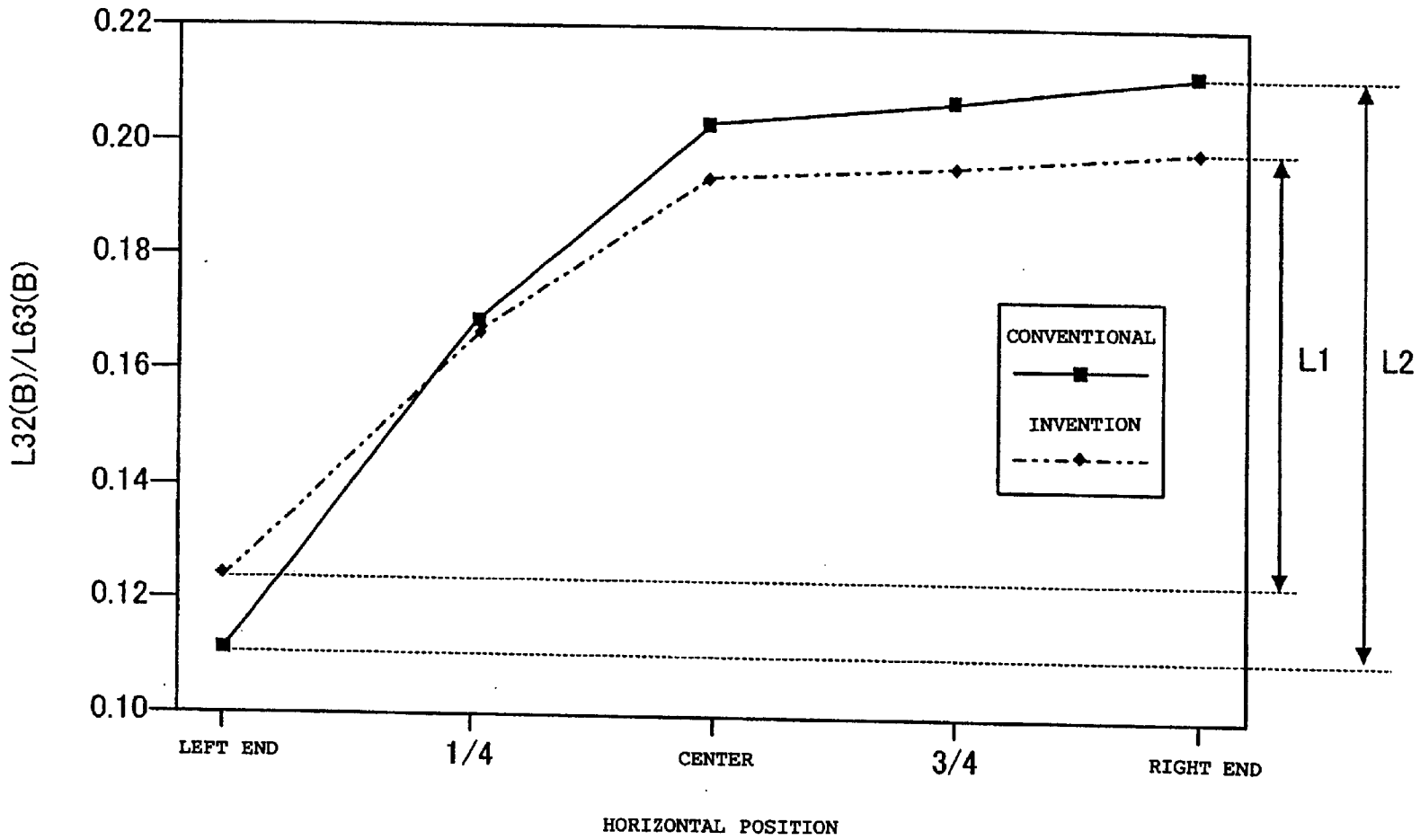
FIG. 6 is a graph of an in-screen horizontal position (abscissa)-luminance (ordinate), showing comparison of changes in luminance distribution in a screen between the conventional art and the present invention.

Next, the effect of uneven luminance reduction by the present invention is shown in FIG. 6: an abscissa indicating a horizontal position in a display screen; an ordinate indicating a measured value of an intermediate level/maximum level of luminance: L32/L63, eliminating a light source and other causes of uneven luminance.

As shown in the graph, compared with the conventional art, the present invention enables a luminance difference L1 between the right end and the left end of the screen to be reduced more than a conventional value L2, making it possible to suppress the uneven luminance in the screen.

Figure 7:
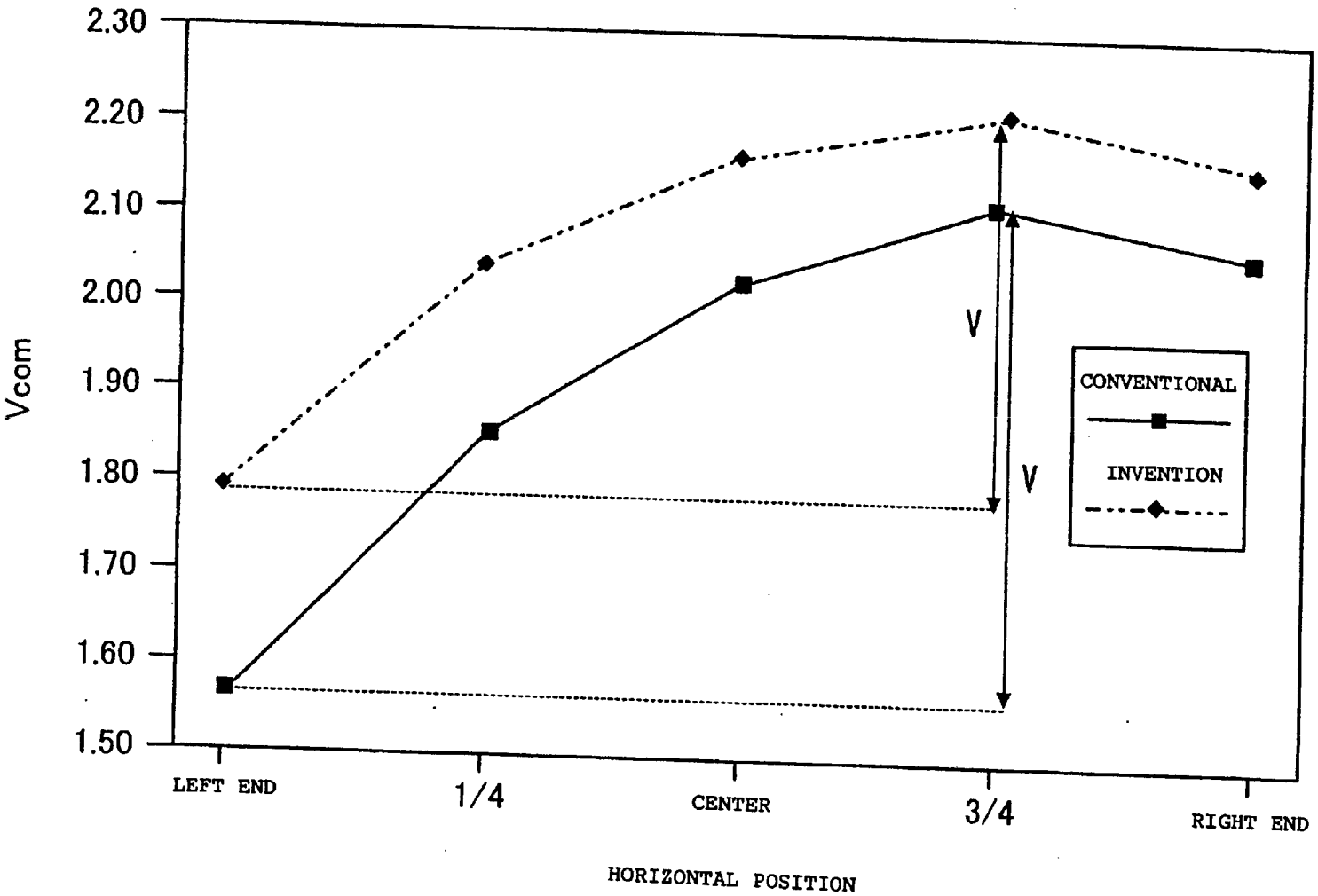
FIG. 7 is a graph of an in-screen horizontal position (abscissa)-an optimum common potential (ordinate), showing comparison of changes in the optimum common potential in a screen between the conventional art and the present invention.
Figure 8:
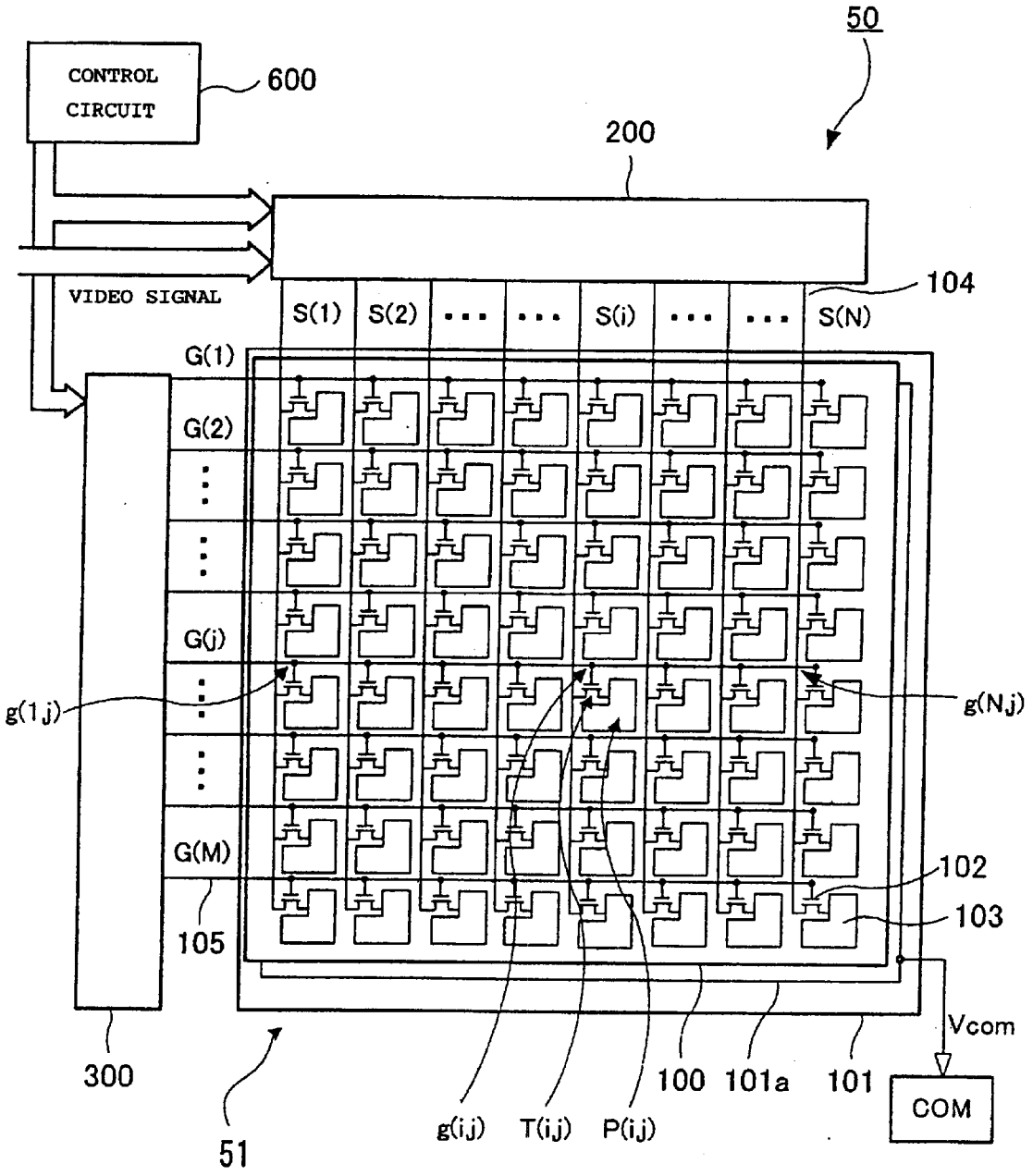
FIG. 8 is a schematic constitutional view of a conventional image display device.
Figure 9:
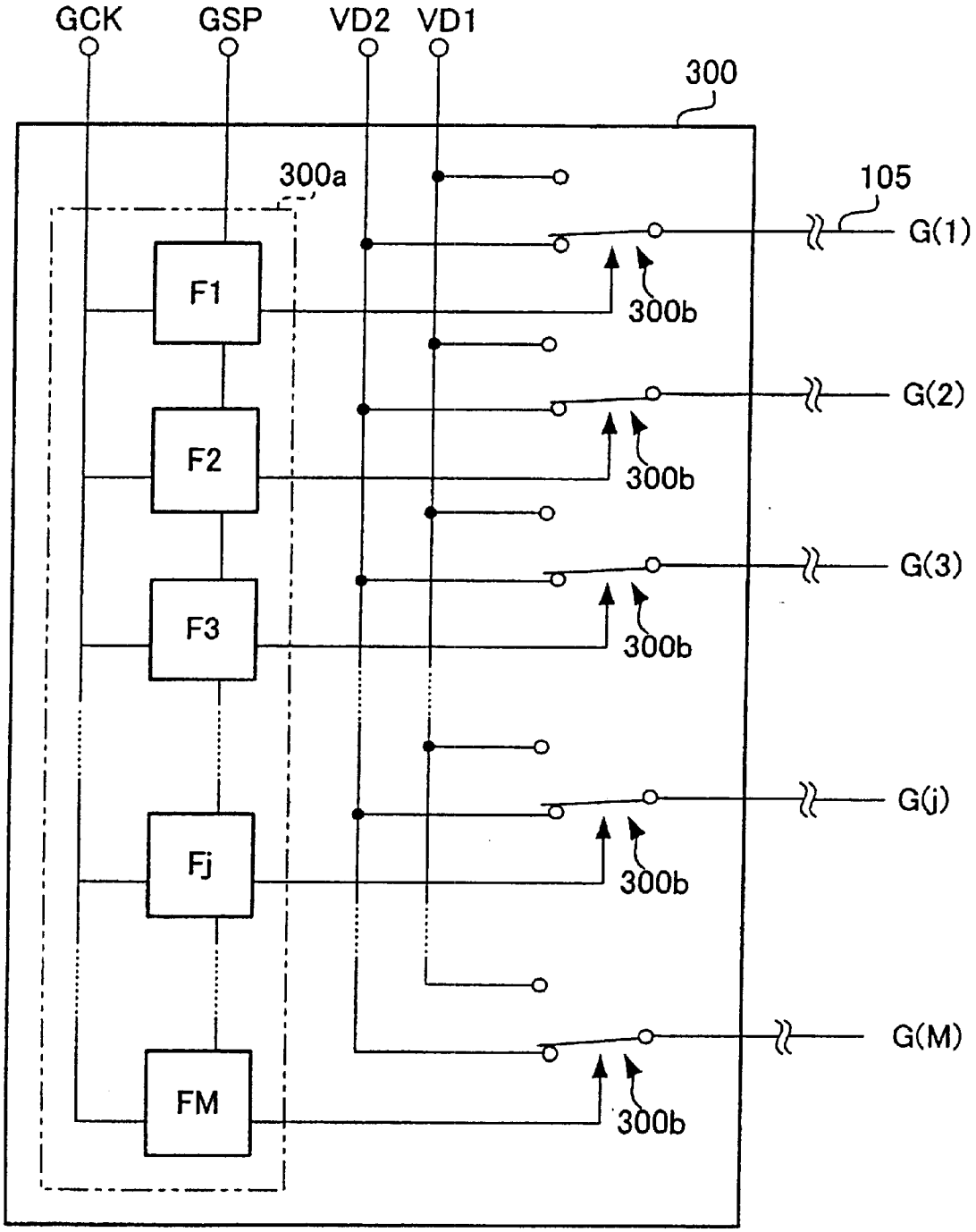
FIG. 9 is a schematic constitutional view of a conventional scanning signal line driving circuit.
Figure 10:
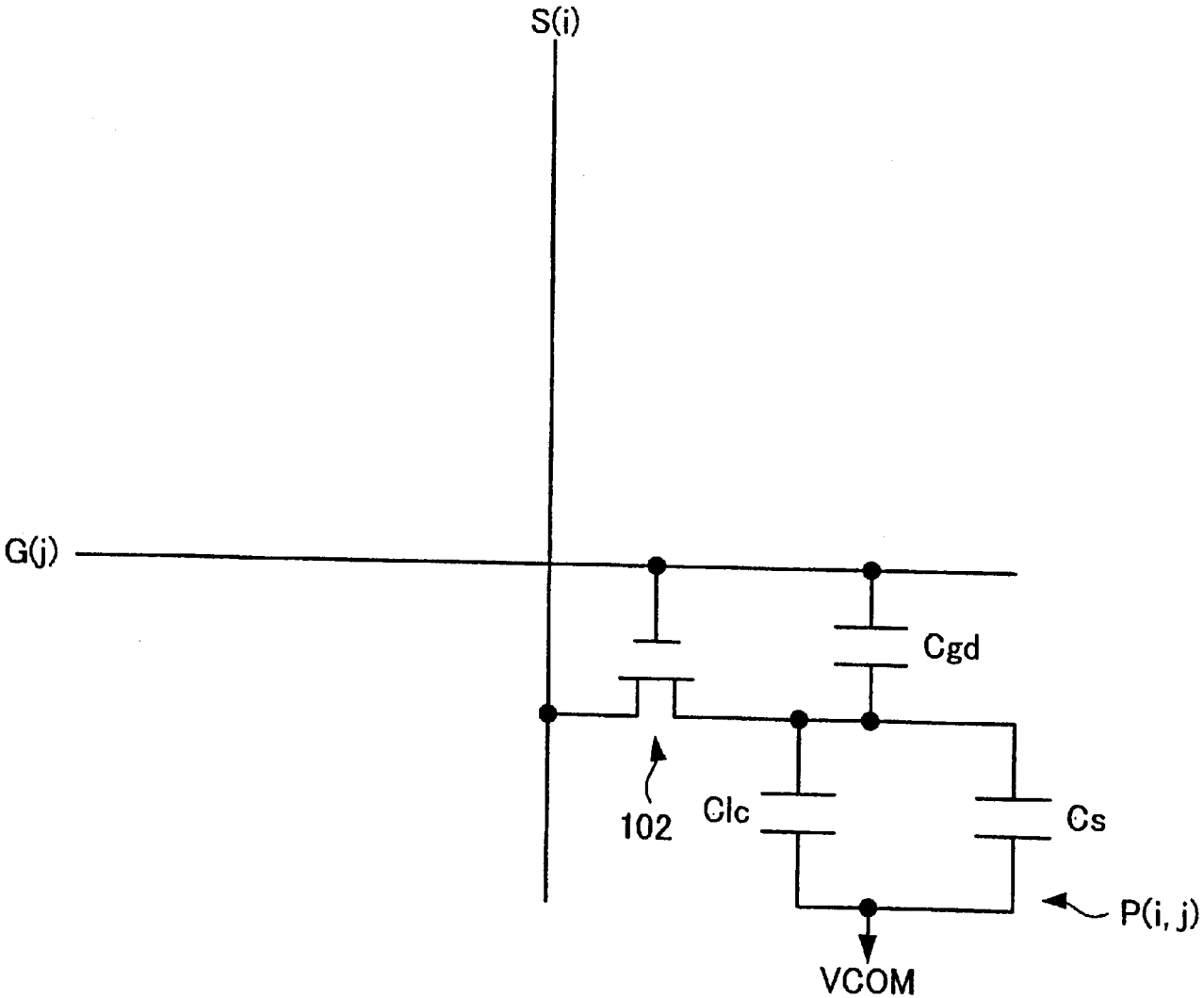
FIG. 10 is an equivalent circuit view of one display pixel having a constitution where a pixel capacitance and an auxiliary capacitance are connected to a counter potential of a counter electrode driving circuit in parallel with each other.
Figure 11:
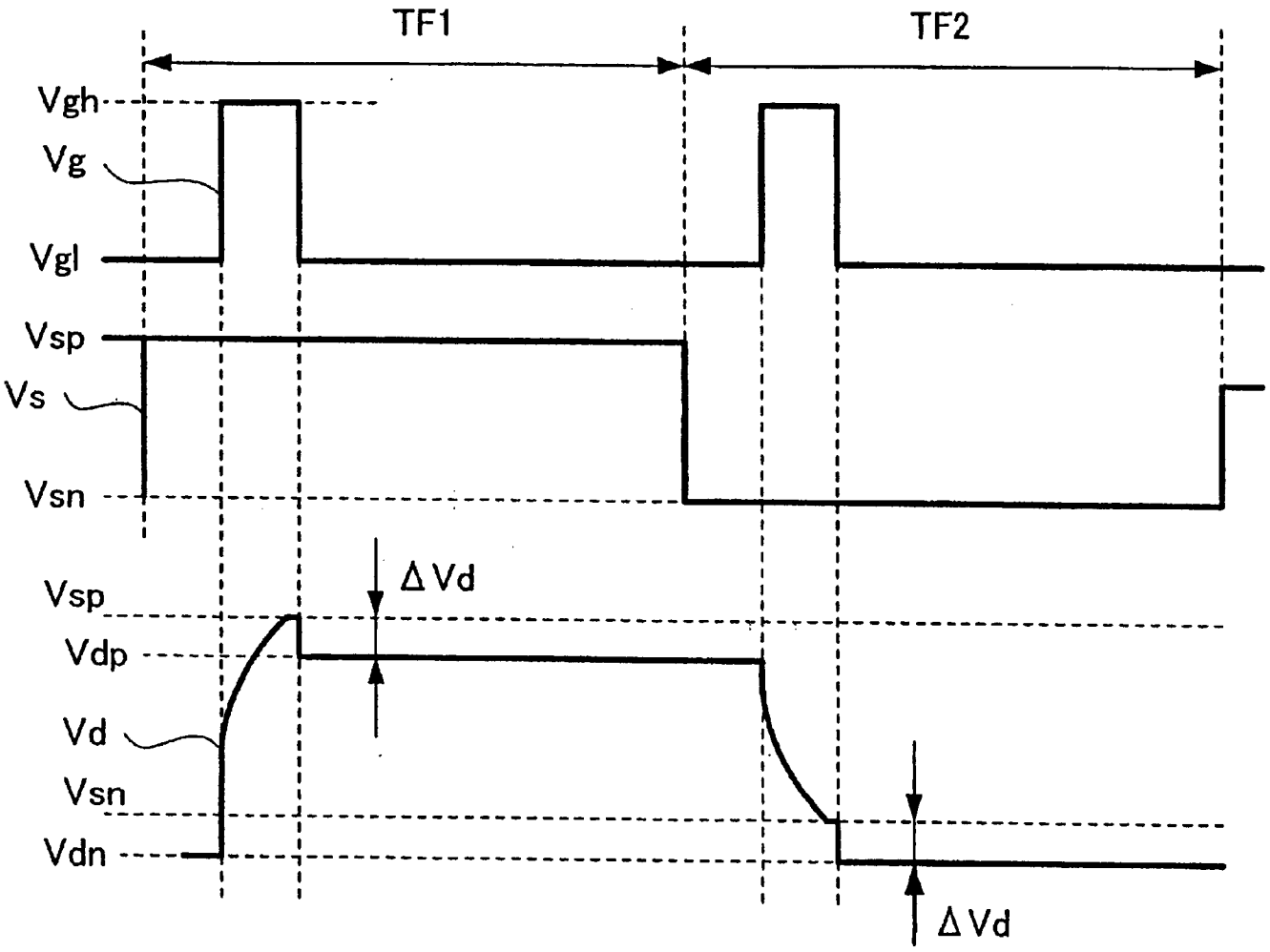
FIG. 11 is a driving waveform diagram of the conventional image display device.
Figure 12:
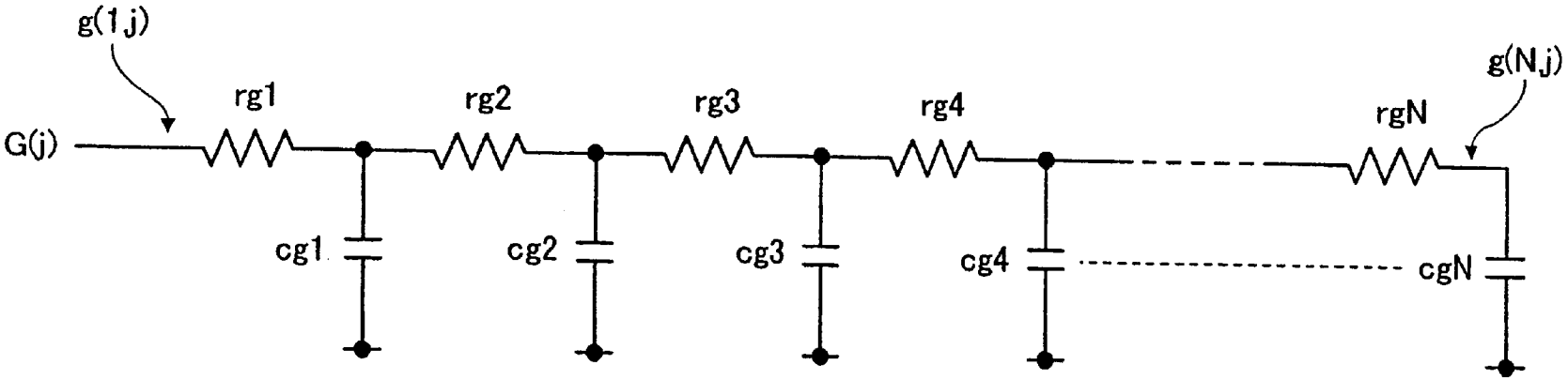
FIG. 12 is a constitutional view of a propagation equivalent circuit when attention is paid to a signal propagation delay of one scanning signal line.
Figure 13:
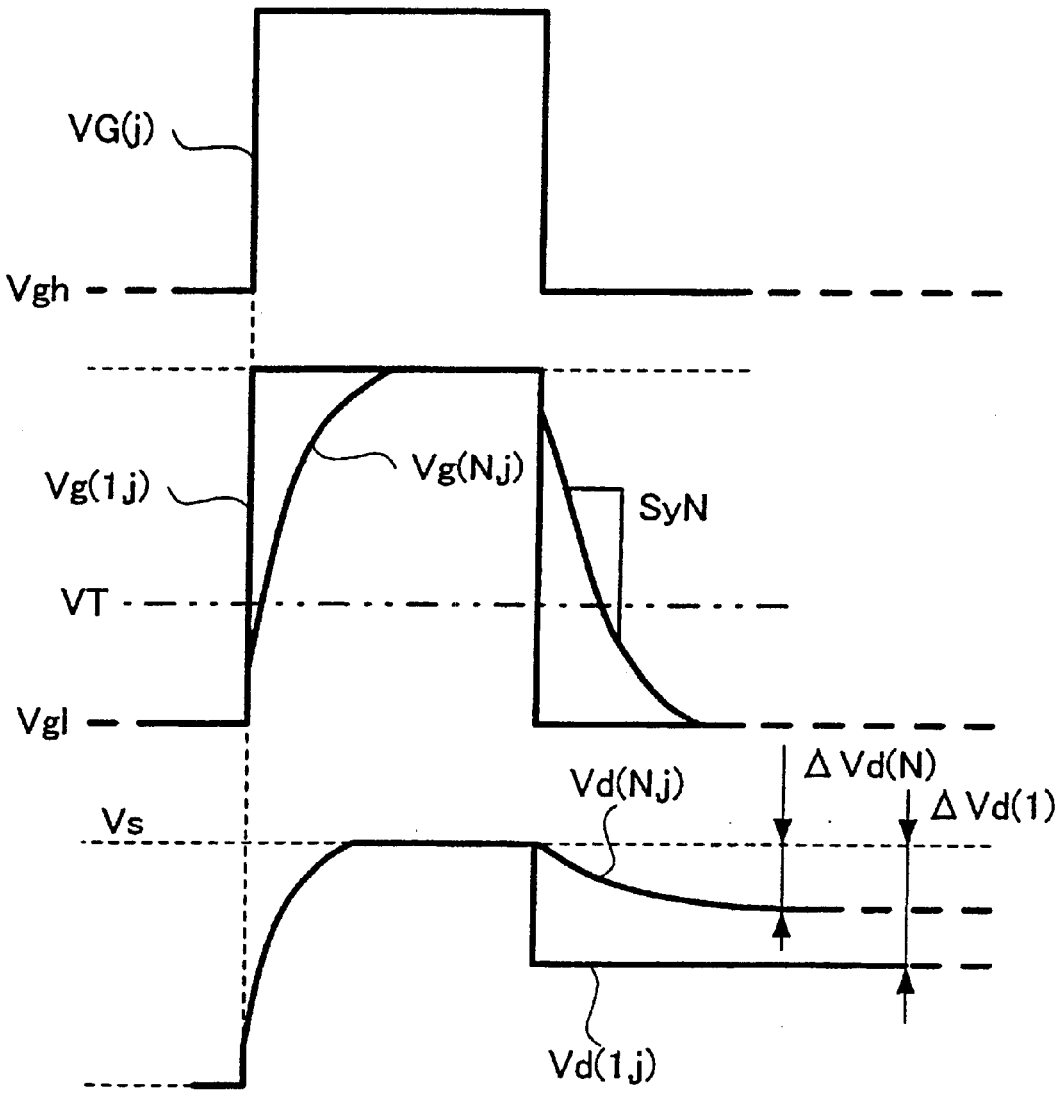
FIG. 13 is a waveform diagram showing a state where a scanning signal, which is inputted from the scanning signal line driving circuit to a scanning signal line, is deformed by a signal propagation delay characteristic of the scanning signal line.
Figure 14:
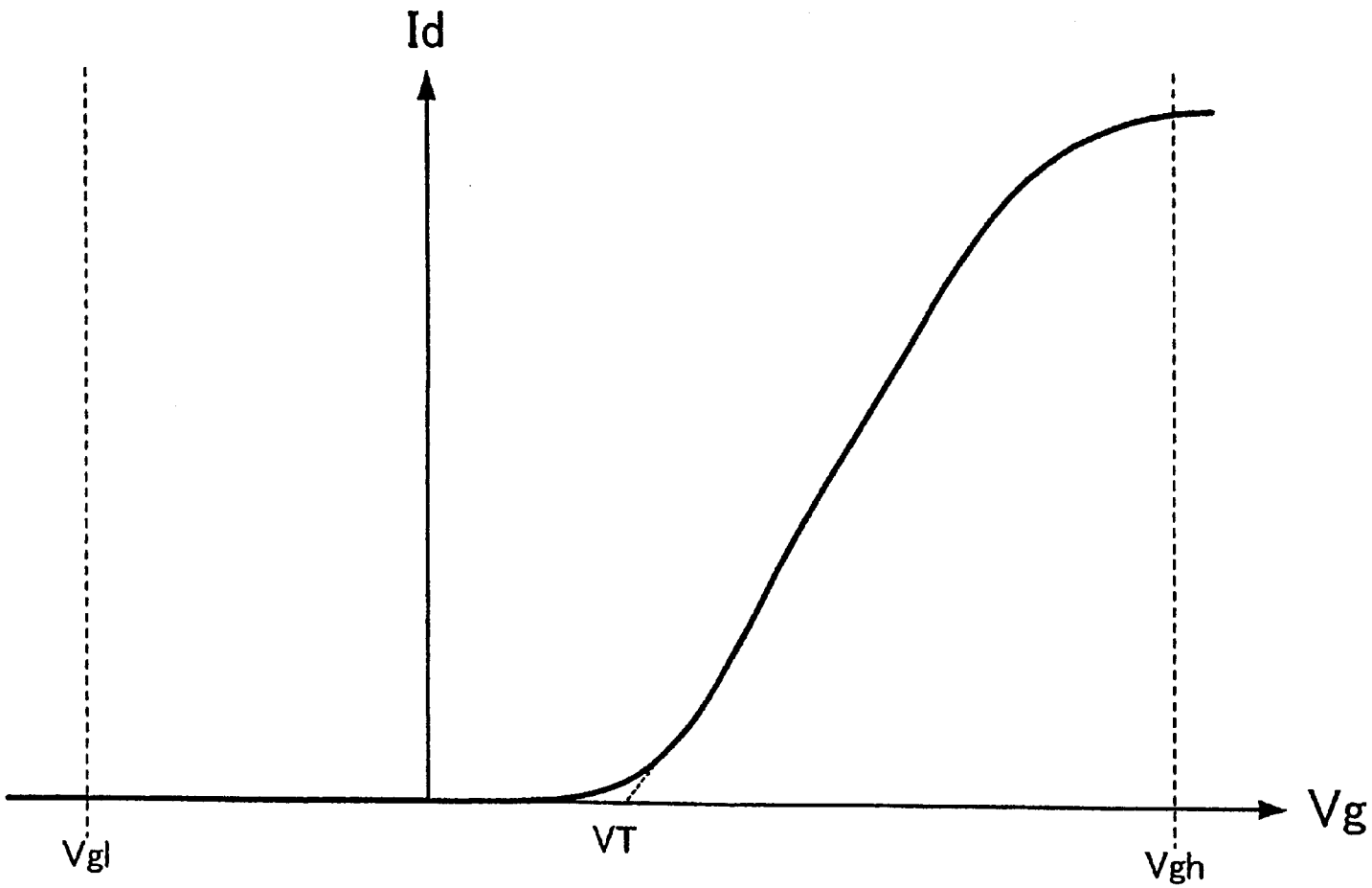
FIG. 14 is a view illustrating that a thin-film transistor is not a complete on and off switch, but has a linear gate voltage-drain current characteristic.

FIG. 7 is a graph showing comparison of changes in an optimum common potential such as minimizes flicker components from the left end to the right end of the screen between the conventional art and the present invention. In FIG. 7, an abscissa indicates a horizontal position in the display screen; and an ordinate indicates an optimum common potential Vcom. As shown in the graph, it can be understood that a maximum value V of a difference between optimum common potentials Vcom in the same screen is decreased because of the reduction of flicker components by the present invention. Thus, since the use of the present invention reduces a maximum DC in the liquid crystal cell 3 when the optimum common potential Vcom is set at a certain point, flicker can be reduced.

As described above, according to the embodiment, the potential output unit for outputting a potential to turn on the switching element T, i.e., the gate signal output unit 10 and the switching unit 16 of the gate driver IC 7 are provided. Moreover, an output waveform from the switching unit 16 is set to include a first waveform having amplitude defined by a potential for turning on the switching element T, i.e., a waveform of the original scanning signal Os, and a second waveform following the first waveform, i.e., a waveform of the oscillation wave Oc. The second waveform is oscillated within a period shorter than the cycle of the original scanning signal Os with amplitude smaller than that of the original scanning signal. Thus, the waveform of the scanning signal Gs (Gs_near and Gs_far) propagated along the scanning line G to reach the switching element T is set, as shown in FIG. 5, to have the rising portion Gs1, the following horizontal portion Gs2, and the falling portion Gs3 falling from on to off at a cycle shorter than the period of the horizontal portion Gs2 while the inclination thereof is oscillated positively and negatively. The falling portion Gs3 can be inclined as a whole compared with the falling portion of the original scanning signal Os. Then, by inputting the scanning signal Gs having such a waveform to each switching element T, it is possible to suppress the nonuniformity of the inclination of the falling waveform of the scanning signal Gs along the scanning line G, and to easily eliminate flicker or uneven luminance of the image in a direction along the scanning line G. As a result, a high quality display image can be easily obtained.

According to the embodiment, the potential output unit includes the start pulse generator 12, the switching unit 16 for controlling the permission of an output of a start pulse generated in the start pulse generator 12, and the control signal supply unit 15 for supplying a control signal Cos controlling the switching unit 16. In other words, since the control signal supply unit 15 is provided outside the gate driver IC 7, it is unnecessary to provide complex circuits in the gate driver IC 7. Accordingly, an inexpensive general-purpose component can be used for the gate driver IC 7, making it possible to obtain a high quality display image at low costs.

In addition, the control signal supply unit 15 supplies the control signal Cos to the switching unit 16, the control signal Cos being composed of a pulse P1 having amplitude defined by a potential for turning on the switching unit 16 and a pulse train P2 oscillating within a period shorter than the cycle of the pulse P1. Accordingly, the switching unit 16 can be operated by the control signal Cos so as to be turned on for a predetermined period, and then repeatedly turned on and off at a short cycle. As a result, the scanning signal Gs outputted to the scanning line G can be easily set to have a waveform as shown in FIG. 4A obtained by adding the oscillation wave Oc to the falling portion of the original scanning signal Os composed of an on-off binary signal.

Also, according to the embodiment, it is not necessary to provide any special circuits or the like between the gate driver IC 7 and the scanning line G. As in the case of a general image display device, the switching unit 16 can be provided in the input end G1 of the scanning line G. Therefore, it is possible to further assure the cost reduction without complicating the constitution of the device.

Moreover, in this case, the control signal supply unit 15 includes the gate pulse generation unit 18 for generating the pulse P1 (gate pulse Gp), the pulse train generation unit (the additional pulse generation unit 19, the mask signal generation unit 20, and the pulse train output unit 22) for generating the pulse train P2 (additional pulse As), and the superposition unit 23 for superposing waveforms thereby generated on one another. Thus, since the control signal supply unit 15 can be easily composed only of a pulse generation mechanism and a superposition mechanism, the device can be easily formed at low costs. In addition, the portions functioning as the pulse train generation unit, i.e., the additional pulse generation unit 19, the mask signal generation unit 20, and the pulse train output unit 22, can also be easily formed at low costs.

According to the embodiment, in the mask signal generation unit 20, the timing of a value "0" of the mask signal Ms, i.e., the timing for partially masking the additional pulse M_Clock is changed based on any one or more characteristics of the scanning line G, the parasitic capacitance accompanying the scanning line G, and the gate driver IC 7 connected to the scanning line G. Accordingly, the timing for adding the pulse train P2 is optimized by allowing the timing to correspond to the device characteristic, making it possible to maximize the effect of preventing flicker or uneven luminance on the screen. Similarly, in the additional pulse generation unit 19, the frequency or the duty ratio of the additional pulse M_Clock is changed in accordance with the characteristics of the scanning line G, the parasitic capacitance accompanying the scanning line G, the gate driver IC 7 connected to the scanning line G, or the like, so that it is possible to maximize the effect of preventing flicker or uneven luminance on the screen.

Furthermore, the cycle of the additional pulse M_Clock, i.e., the cycle of the oscillation wave Oc added to the original scanning signal Os, is set shorter than the period Tgs3' of the falling portion Gs3' of the scanning signal Gs_far' which is supplied to the switching element T connected to the termination G2 of the scanning line G based on the control signal Gs', thus providing a proper oscillation waveform at the falling portion Gs3. As a result, it is possible to further assure the effect of inclining the falling portion Gs3.

The present invention is not limited to the foregoing embodiment, and other constitutions can be employed as occasion demands. For example, in the foregoing embodiment, the control signal supply unit 15 is provided outside the gate driver IC 7. However, there should be no limitation in this regard, and the control signal supply unit 15 may be incorporated in the gate driver IC 7.

In the foregoing embodiment, the switching unit 16 is incorporated in the gate driver IC 7. However, there should be no limitation in this regard, and logically identical one thereto may be provided outside the gate driver IC 7.

The constitution of the gate driver IC 7 shown in FIG. 1 is only one example, and other constitutions may be employed.

In the foregoing embodiment, the additional pulse Pa composed of the rectangular pulse is added to the gate pulse Gp. However, there should be no limitation in this regard, and as the additional pulse Pa, a signal composed of other waveforms such as a triangular pulse, a sine waveform and the like may be used.

Other than the above, some portions of the embodiment can be omitted/selected, and the constitution can be properly changed to others within the teachings of the present invention.

As is apparent from the foregoing, the present invention is advantageous in that a falling waveform of a scanning signal can be easily inclined, and a high quality image can be realized at low costs, different from the case of the conventional art.

Although the preferred embodiments of the present invention have been described in detail, it should be understood that various changes, substitutions and alternations can be made therein without departing from spirit and scope of the inventions as defined by the appended claims.

What is claimed is:

1. An image display device comprising:

a plurality of pixel electrodes;

a display signal supply unit for supplying a display signal to each of said plurality of pixel electrodes;

a display signal control element for controlling the supplying of the display signal to each of said plurality of pixel electrodes; and a potential output unit for outputting a potential to said display signal control element, wherein said potential output unit sets an output waveform to have a first waveform having an amplitude defined by a potential for turning on said display signal control element, and a second waveform following said first waveform and oscillated with an amplitude smaller than the amplitude of said first waveform within a period shorter than a period of said first waveform.

2. The image display device according to claim 1, wherein said potential output unit includes:

an original scanning signal output unit for outputting an original scanning signal composed of a pulse waveform;

an output control unit for controlling permission of an output of said original scanning signal to said display signal control element; and a control signal supply unit for supplying a control signal for controlling said output control unit.

3. The image display device according to claim 2, wherein said control signal supply unit supplies a control signal to said output control unit, the control signal being composed of a pulse for turning on said output control unit, and a pulse train following said pulse and oscillated within a period shorter than a cycle of said pulse.

4. The image display device according to claim 3, wherein said control signal supply unit includes:

a pulse generation unit for generating said pulse;

a pulse train generation unit for generating said pulse train; and a superposition unit for superposing waveforms generated by said pulse generation unit and said pulse train generation unit.

5. The image display device according to claim 4, wherein said pulse train generation unit includes:

an additional pulse generation unit for continuously generating additional pulses constituting said pulse train;

a mask signal generation unit for generating a mask signal for partially masking said additional pulses at a predetermined cycle; and a pulse train output unit for outputting a logical product of said additional pulses and said mask signal as said pulse train.

6. The image display device according to claim 5, wherein said mask signal generation unit changes a timing of said mask signal for partially masking said additional pulses based on at least one of characteristics of a scanning line connecting said output control unit with said display signal control element, a parasitic capacitance accompanying said scanning line, and a gate driver IC constituting said output control unit.

7. The image display device according to claim 2, wherein said output control unit is provided in an input end of a scanning line for applying a potential for turning on said display signal control element.

8. An image display controller for outputting a scanning signal for controlling permission of a supply of a display signal to a pixel electrode, comprising:

a scanning signal generation unit for generating said scanning signal;

a switching unit for controlling an output of said scanning signal from said scanning signal generation unit; and a control signal generation unit for outputting a control signal for controlling an operation of said switching unit, wherein said control signal generation unit includes:

an original signal output unit for outputting an original signal composed of a rectangular pulse;

an additional signal output unit for outputting an additional signal repeatedly turning on and off for a predetermined period including a falling timing of said original signal; and a control signal output unit for generating a signal having said additional signal added to said original signal, as said control signal.

9. The image display controller according to claim 8, wherein said additional signal is a rectangular pulse wave.

10. The image display controller according to claim 9, wherein a duty ratio of said rectangular pulse wave is determined based on a characteristic of a device to which said scanning signal is outputted.

11. A display control method for controlling a display image by supplying a display signal to a pixel electrode through a display signal control element controlled for turning on and off by a scanning signal, comprising:

a step (A) of adding an oscillation wave to a predetermined area including a falling portion of an original scanning signal set as an on and off binary signal;

a step (B) of inclining a falling waveform portion of a scanning signal in comparison with a falling portion of the original scanning signal by outputting a signal obtained by adding said oscillation wave to said original scanning signal as said scanning signal to a scanning line accompanied with a parasitic capacitance; and a step (C) of supplying said scanning signal having the inclined falling waveform portion from said scanning line to said display signal control element.

12. The display control method according to claim 11, wherein, in said step (A), to add said oscillation wave, the turning on and off of the output of said original scanning signal is controlled to be turned on for a predetermined period, and then repeatedly turned on and off within a period shorter than said predetermined period.

13. The display control method according to claim 11, wherein said oscillation wave oscillates with amplitude identical to amplitude of the turning on and off of said original scanning signal.

14. The display control method according to claim 11, wherein a characteristic of said oscillation wave is determined based on at least one of characteristics of said scanning line, a parasitic capacitance accompanying the scanning line, and a gate driver IC connected to said scanning line.

15. The display control method according to claim 11, wherein a cycle of said oscillation wave is set to be shorter compared with a falling time of the scanning signal, which is supplied to said display signal control element connected to a termination side of said scanning line when assuming that said original scanning signal is directly inputted to an input end of said scanning line.

* * * * *